United States Patent [19]

Moomaw et al.

[11] Patent Number: 4,896,877

[45] Date of Patent: Jan. 30, 1990

[54] INCREMENTALLY ROTATABLE TEETER-TOTTER

[75] Inventors: David E. Moomaw, East Aurora; Wade A. F. Maple, Elma; Robert J. Boggs, East Aurora, all of N.Y.

[73] Assignee: The Quaker Oats Company, Chicago, Ill.

[21] Appl. No.: 373,043

[22] Filed: Jun. 28, 1989

Related U.S. Application Data

[63] Continuation-in-part of Ser. No. 232,489, Aug. 15, 1988, abandoned.

[51] Int. Cl.[4] ..... A63G 1/32

[52] U.S. Cl. ..... 272/30; 272/33 R; 272/54; 272/55

[58] Field of Search ..... 272/28 R, 30, 34, 50, 272/54, 55, 56, 33 A, 33 R, 33 B, 43–45

[56] References Cited

U.S. PATENT DOCUMENTS

| | | | |
|---|---|---|---|
| 1,014,249 | 1/1912 | Ney | 272/30 |
| 1,254,174 | 1/1918 | Thebert | 272/30 |
| 2,109,897 | 3/1938 | Braunschweig | 272/30 |
| 2,558,431 | 6/1951 | Grover | 272/30 |
| 2,809,036 | 10/1957 | Meixsell | 272/30 |

*Primary Examiner*—Richard E. Chilcot, Jr.
*Attorney, Agent, or Firm*—Cumpston & Shaw

[57] ABSTRACT

A teeter-totter is disclosed that simultaneously incrementally rotates as it pivots up-and-down. The teeter-totter comprises a base having a fulcrum about which a beam is pivotally mounted for up-and-down movement. The beam is coupled to the fulcrum by a mechanism that simultaneously incrementally rotates the beam upon movement of the beam in at least one of the up-and-down directions.

21 Claims, 8 Drawing Sheets

INCREMENTALLY ROTATABLE TEETER-TOTTER

CROSS REFERENCE TO RELATED APPLICATIONS

This is a continuation-in-part of application Ser. No. 07/232,489 filed Aug. 15, 1988 now abandoned.

BACKGROUND OF THE INVENTION

1. Field of the Invention

The present invention relates generally to toys, and more particularly to a teeter-totter that incrementally rotates as it moves up-and-down.

2. Description of the Prior Art

Teeter-totters of the type wherein a beam is pivotally mounted on a fixed pivot are well-known in the art. Teeter-totters that are mounted on a rotatable pivot are also well-known in the art.

SUMMARY OF THE INVENTION

An object of the present invention is to provide a preferred embodiment of a teeter-totter in accordance with the invention that simultaneously incrementally rotates as it pivots up-and-down. The teeter-totter comprises a base having a pedestal, and a beam mounted on the pedestal for simultaneous rotatable and pivotal movement. Means are provided for coupling the beam to the base for simultaneously incrementally rotating the beam upon each movement of the beam in at least one of the up-and-down directions.

In a more specific aspect of the invention, the means coupling the beam to the base comprises a U-shaped spring member formed of two L-shaped springs, each having one end portion secured to the beam and an opposite depending spring arm. The base has a fixed circular toothed member having teeth on the periphery thereof. Tooth pawls are provided in engagement with substantially diametrically opposed teeth on the circular toothed member, and the pawls are provided with openings for receiving the complementary spring arms.

BRIEF DESCRIPTION OF THE DRAWINGS

The invention will be described with respect to the drawings, wherein.

DETAILED DESCRIPTION OF THE PREFERRED EMBODIMENT

Because teeter-totters are well-known, the present description will be directed in particular to elements forming part of, or cooperating directly with, a teeter-totter in accordance with the present invention. It is to be understood that elements not specifically shown or described may take various forms well-known to those skilled in the art.

Figure 1:
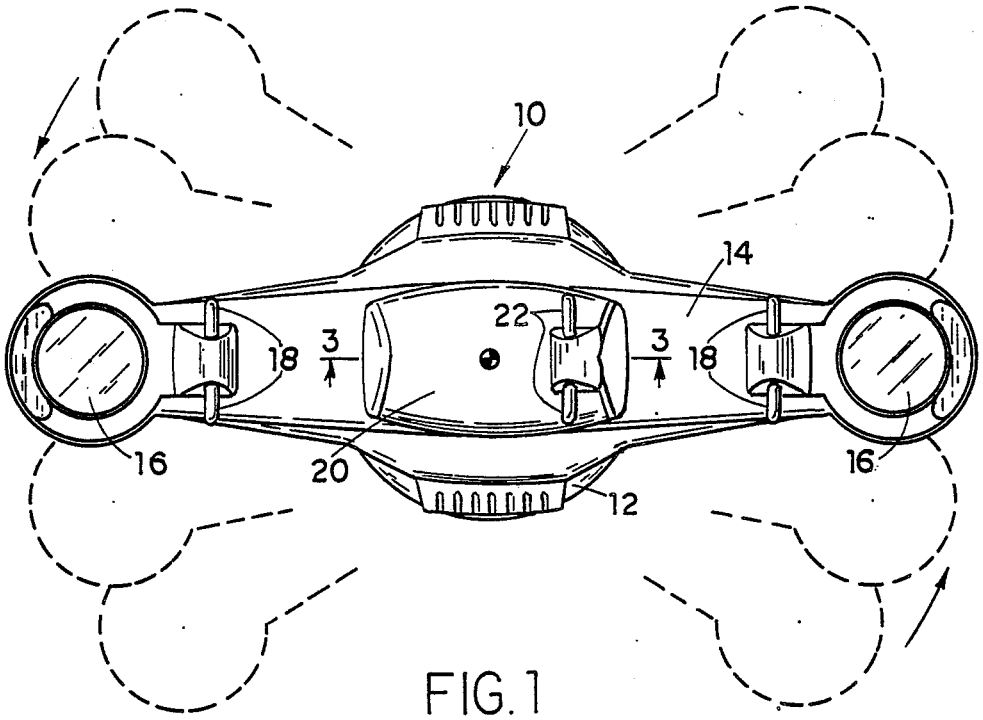
FIG. 1 is a top plan view of a preferred embodiment of a teeter-totter in accordance with the present invention.
Figure 2:
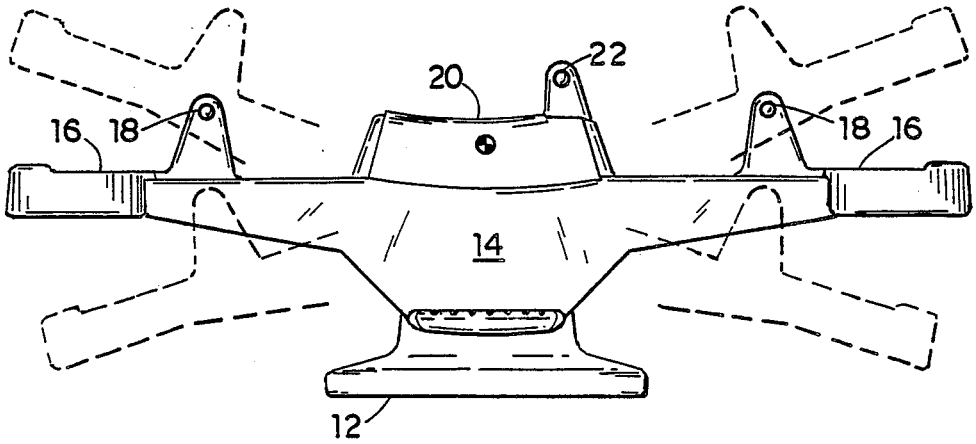
FIG. 2 is a front elevational view of the teeter-totter of FIG. 1.

With reference to FIGS. 1 and 2, a preferred embodiment of a teeter-totter 10 that simultaneously incrementally rotates as it pivots up-and-down is disclosed in accordance with the present invention. The teeter-totter comprises a base 12 for pivotally and rotatably supporting a beam 14 having seats 16 and handles 18 adapted to accommodate a child at each end thereof, and a center seat 20 and handles 22 for accommodating a single child.

Figure 3:
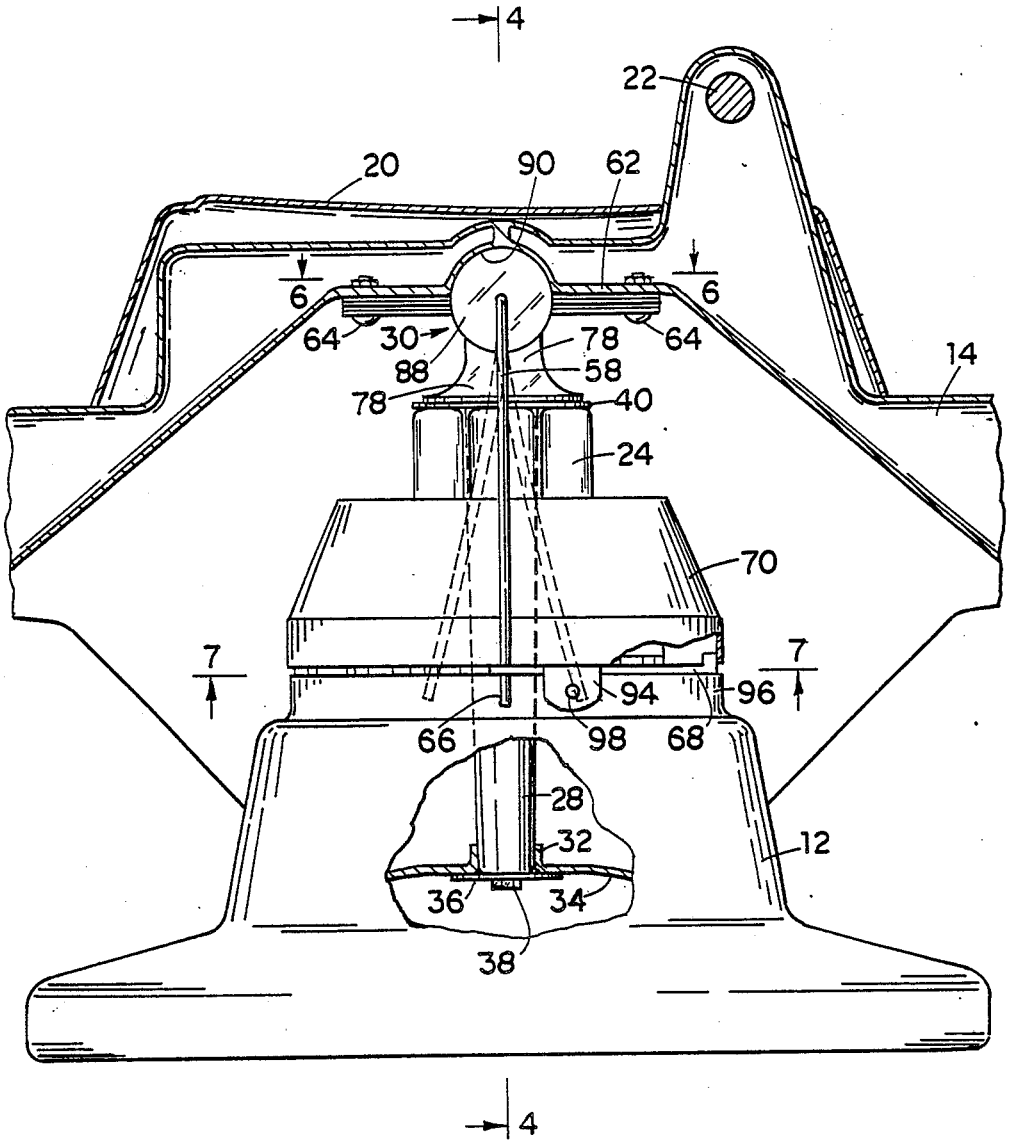
FIG. 3 is a segmental enlarged section view taken substantially along line 3—3 of FIG. 1.
Figure 4:
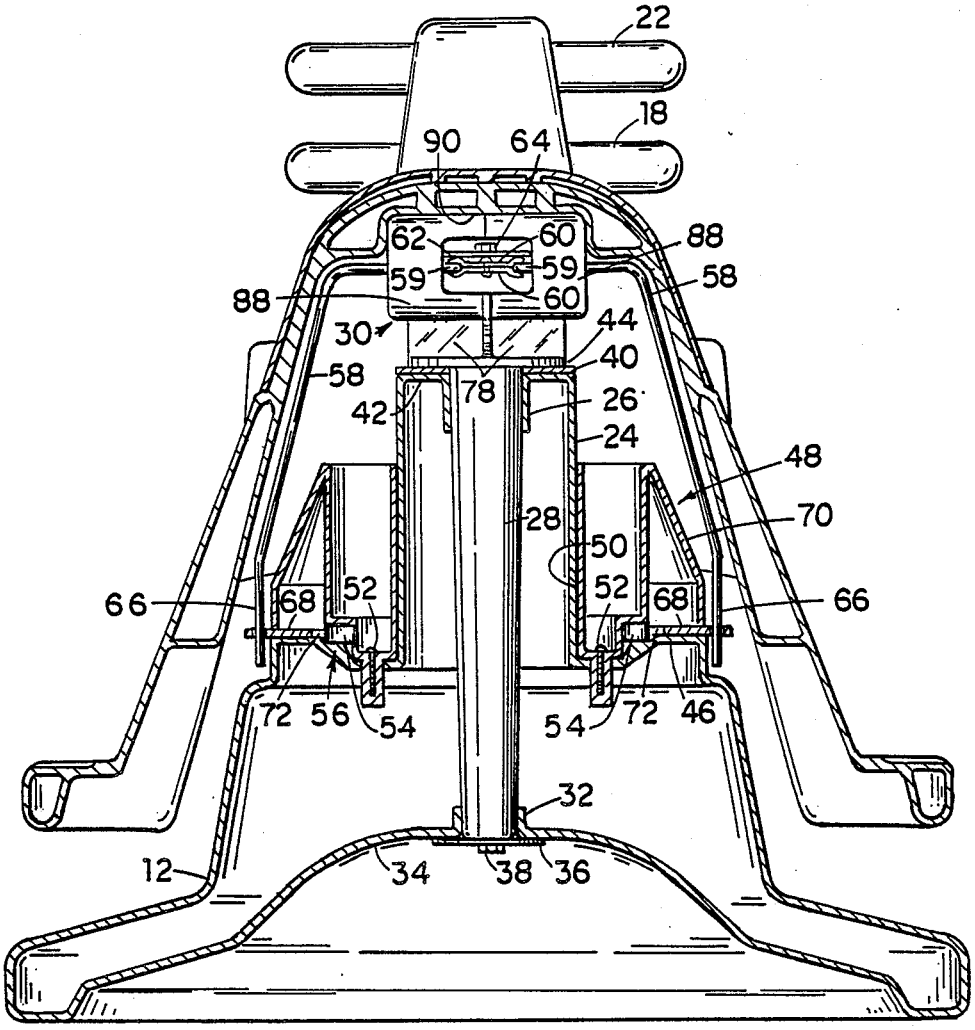
FIG. 4 is a section view taken substantially along line 4—4 of FIG. 3.
Figure 5:
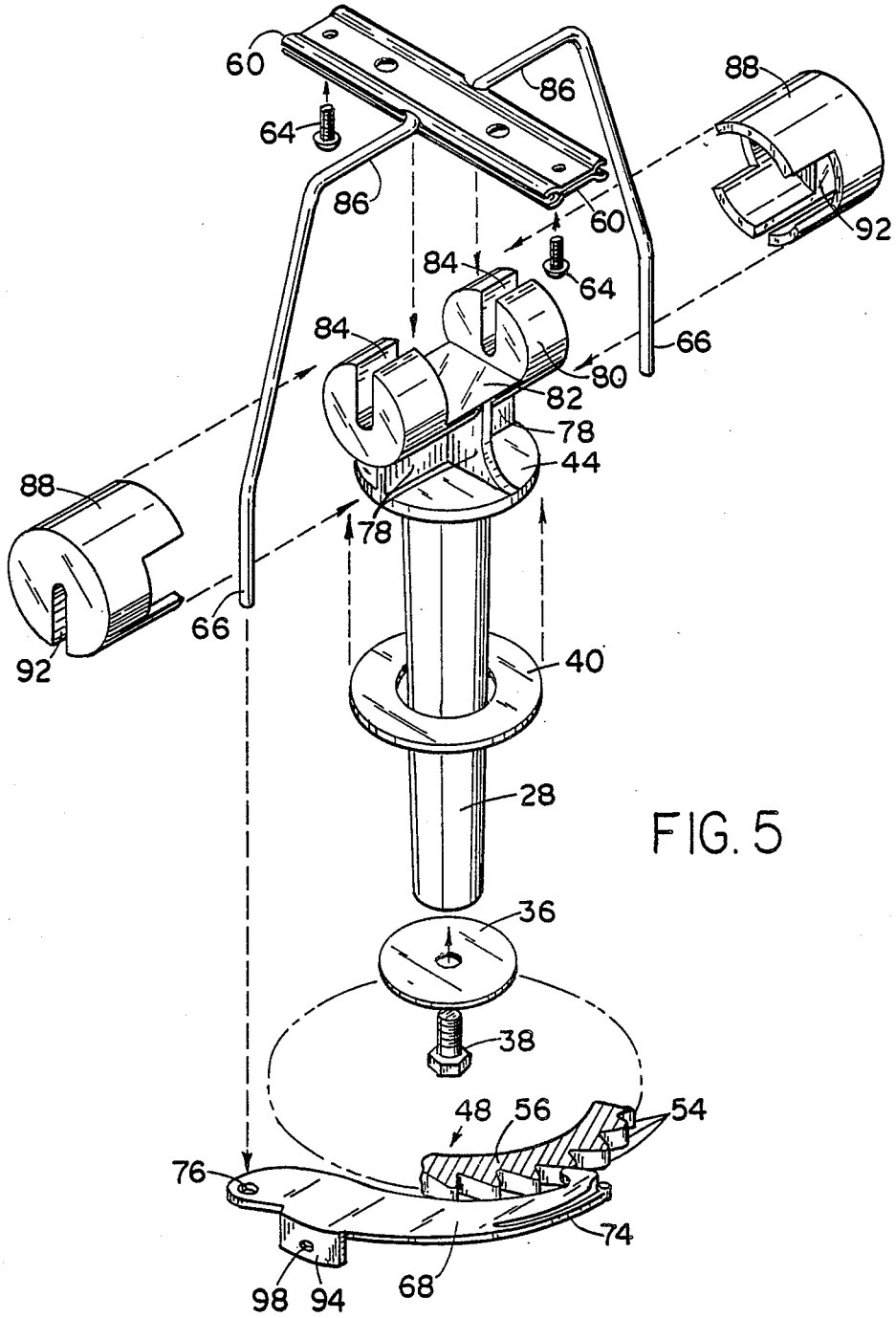
FIG. 5 is an enlarged isometric view of the mounting mechanism for the U-shaped spring member.

Referring to FIGS. 3–5, base 12 has a central upstanding pedestal 24 provided with a vertically oriented collar 26 (FIG. 4) having an opening for receiving one end of a spindle 28 of a rotatable beam support member 30. The opposite end of spindle 28 nests in a collar 32 in a lower wall 34 of base 12 and has a washer 36 and nut 38 for securing the beam support member 30 to pedestal 24. A washer 40 is preferably interposed between a top wall 42 of the pedestal and a bottom wall 44 of beam support member 30 to reduce the friction therebetween.

Figure 7:
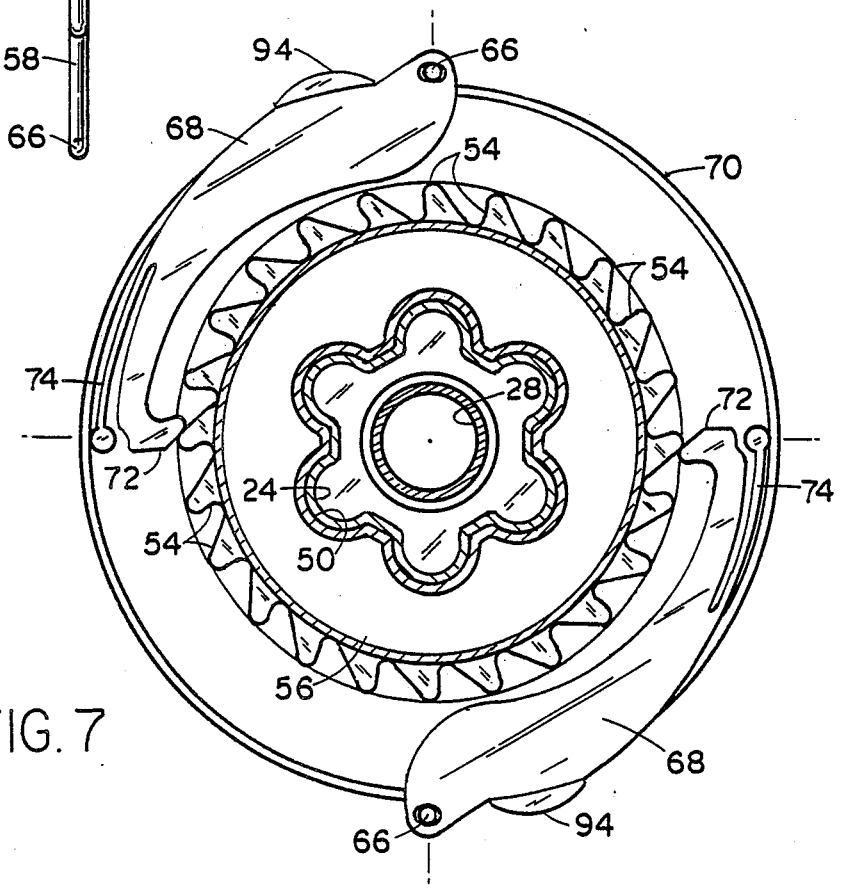
FIG. 7 is a section view taken substantially along line 7—7 of FIG. 3.

The base 12 is further provided (FIG. 4) with an annular land 46 on which a doughnut-shaped gear support member 48 is mounted. The outer periphery of base 12 has a non-circular configuration or shape for slidably receiving a complementary opening 50 in gear support member 48 (FIGS. 4 and 7). The gear support member is secured to annular and 46 by screws 52. The lower end of gear support member 48 further has integral gear teeth 54 on the outer periphery thereof to form a fixed circular gear 56, as best seen in FIGS. 5 and 7.

Figure 6:
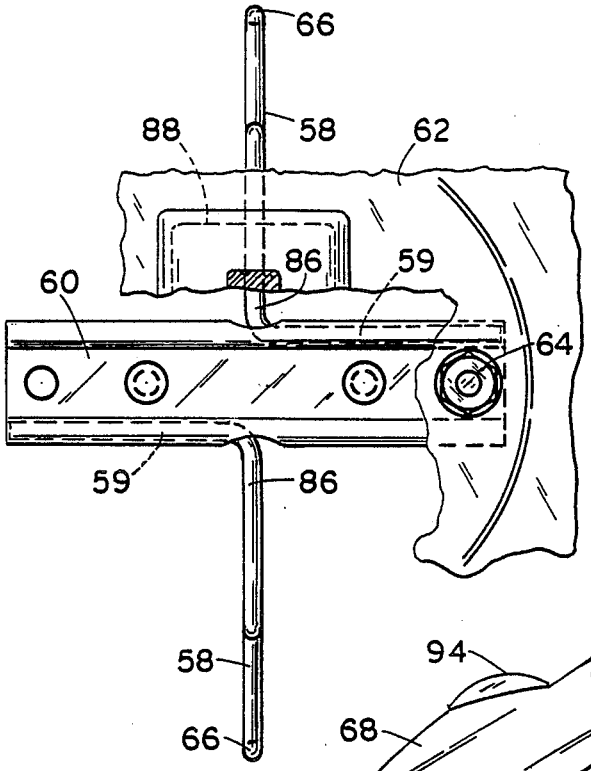
FIG. 6 is a segmental section view taken substantially along line 6—6 of FIG. 3.

The teeter-totter is further provided with means for coupling beam 14 to circular gear 56 for imparting incremental rotation to the beam during its up-and-down motion. The coupling means comprises a U-shaped spring member formed from a pair of L-shaped spring arms 58 having the bent ends 59 thereof clamped together between a pair of clamp members 60 (FIGS. 5 and 6). The clamp members are secured to a lower wall 62 of beam 14, by bolts 64 (FIG. 3) for imparting pivotal movement to arms 58 and depending ends 66 thereof upon pivotal movement of the beam by one or more children. A pair of tooth engaging pawls 68, one on each side of circular gear member 56, as best seen in FIGS. 5 and 7, are held captive between land 46 and the end of an apron 70 on gear support member 48 in a position in which a toothed end 72 thereof is biased by an integral spring finger 74 into engagement with teeth 54 of circular gear 56. Each of the pawl members 68 has an opening 76 extending through the other end thereof for receiving free ends 66 of depending spring arms 58.

With particular reference to FIG. 5, the beam supporting end of beam support member 30 comprises fins 78 extending upwardly from bottom wall 44 for supporting a cylindrical member 80 integral therewith. Member 80 has a slot 82 for receiving clamp members 60 and slots 84 for receiving arm portions 86 adjacent spring ends 59 which nest therein for pivotal movement of the clamp members 60 and spring arms 58 relative to member 80. A pair of cylindrical end caps 88 is provided on the ends of cylindrical member 80 for retaining clamp members 60 and spring arms 58 on to beam support member 80, and to form a fixed pivot for a beam socket 90 (FIG. 3) mounted thereon. Each end cap 88 has a slot 92 for receiving a fin 78 as the end cap is slid over an end of cylindrical member 80.

Figure 8:
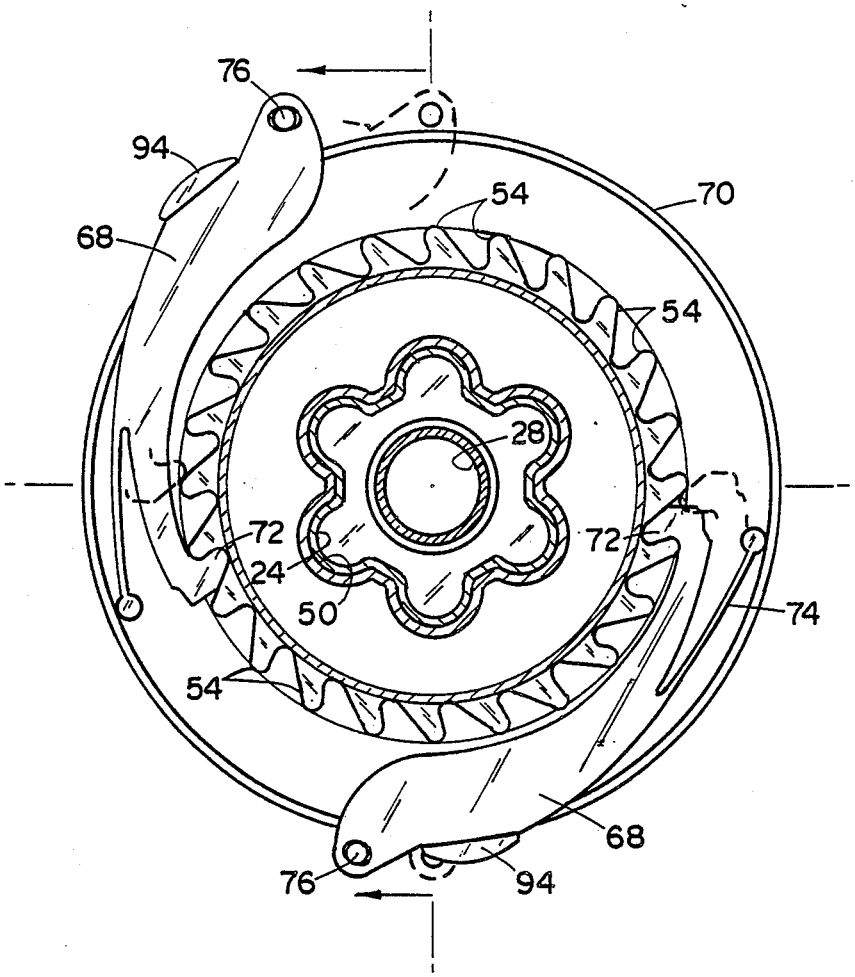
FIG. 8 is a view similar to FIG. 7 showing the position of the pawls upon movement of the beam in one of the up or down directions.
Figure 9:
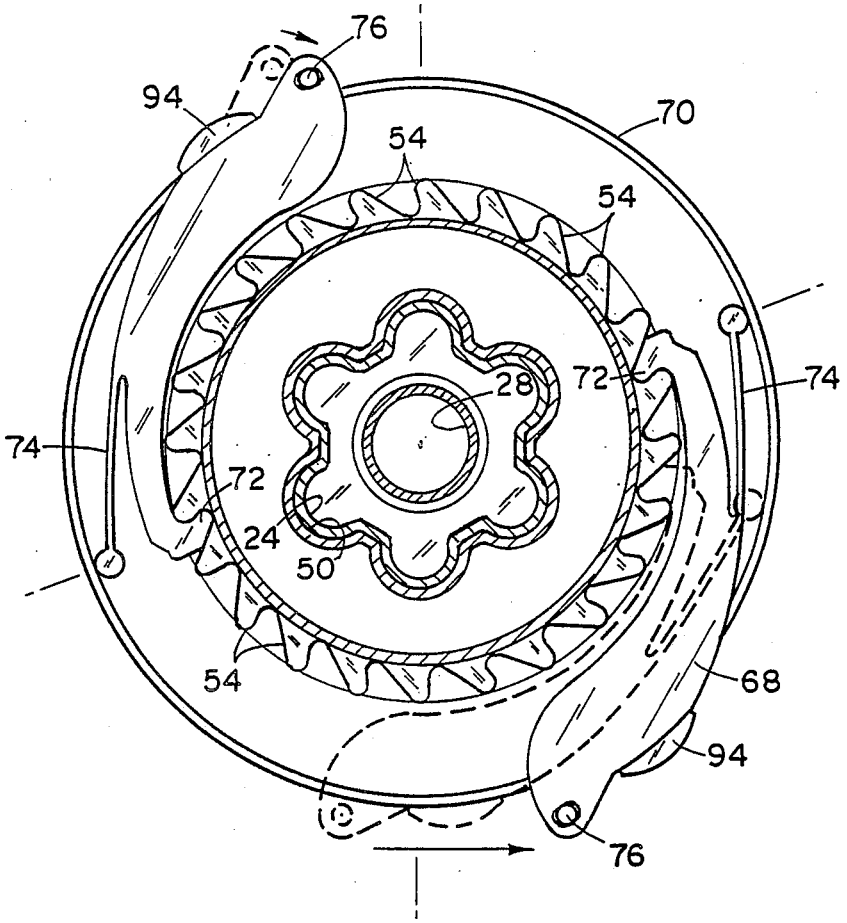
FIG. 9 is a view similar to FIG. 7 showing the position of the pawls upon movement of the beam in the other direction.

When beam 14 is in its normal horizontal position, spring arms 58 are untensioned and the arms and pawls 68 assume the position shown in FIG. 7. From this position, pivotal movement of the beam clockwise, as seen in FIGS. 2 and 3, tensions spring arms 58 in the direction shown by the arrows in FIG. 8 causing one of the pawls 68 to engage a tooth 54 and to be held therein while the other pawl 68 slips over one or more teeth 54 as the beam is rotated counter-clockwise through a small angle, as seen in FIG. 1. Movement of beam 14 in the opposite clockwise direction, as seen in FIGS. 2 and 3, causes the other pawl 68 to be moved into engagement with a tooth 54 and the first pawl 68 to slide over one or more teeth 54, as seen in FIG. 9, imparting another small incremental movement to the beam in the counter-clockwise direction, as seen in FIG. 1.

Means are provided to prevent rotational movement of base 14 in the event only up-and-down motion of the base is desired. The preventing means comprises a depending tab 94 (FIG. 5) on each of the pawls 68 which overlaps a rim 96 on base 12. Tabs 94 have openings 98 through which screws, not shown, are screwed into rim 96 to secure the pawls to the fixed base.

Figure 10:
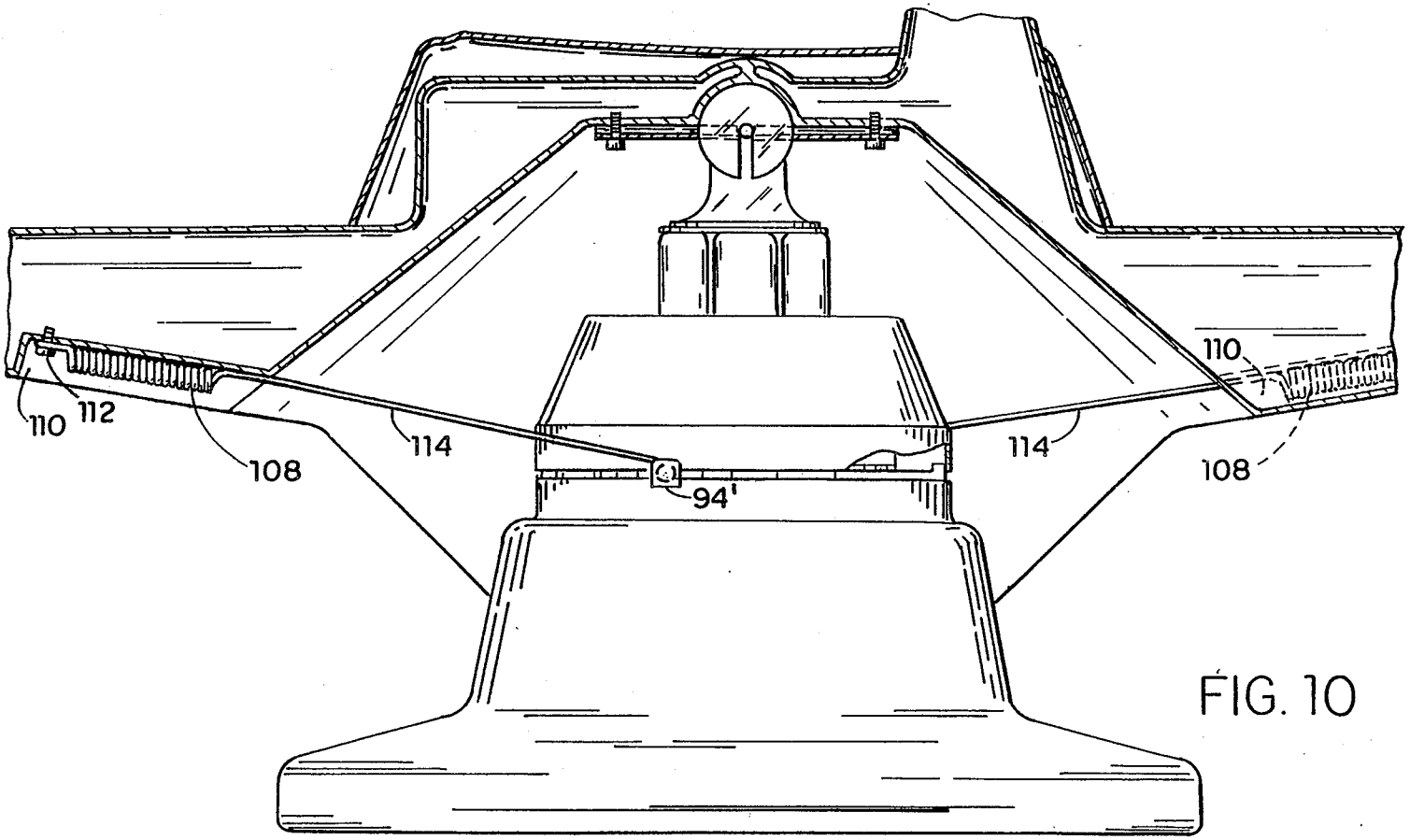
FIG. 10 a side elevation, partly in section, of a teeter-totter in accordance with an alternative embodiment of this invention.

An alternative embodiment of this invention utilizing coil springs is shown in FIG. 10. The U-shaped spring member of the embodiment described above is replaced by a pair of coil springs 108, each having a first end received within a pair of recesses 110 formed in the underneath surface of the beam 14. One end of each of spring members 108 is fastened within recess 110 by a bolt 112, or similar suitable fastening means. The opposite end of each spring 108 is preferably an extended straight rod portion 114 attached to a suitably modified tab 94' by conventional means, not illustrated.

Preferably, the springs 108 are sized such that in the unloaded balanced position of the beam, each of the springs is at least slightly tensioned, whereby the beam is maintained in the balanced position by the force of the springs. When one end of the beam is displaced from the equilibrium position, it is urged back towards the balanced condition by increased tension on the opposite spring. Thus, by appropriately selecting the strength of the springs, a single rider sitting on the center seat may use the teeter totter, rocking solely against the force of the springs 108.

The invention has been described in detail with particular reference to a preferred embodiment thereof, but it will be understood that variations and modifications can be effected within the spirit and scope of the invention.

What is claimed is:

1. A teeter-totter that simultaneously incrementally rotates as it pivots up-and-down comprising:

a base;

a support member rotatably mounted on the base;

a beam mounted on the support member for rotatable movement therewith and for pivotal movement in up-and-down directions;

spring means secured to the beam: and means on the base coupling the spring means to the base for simultaneously incrementally rotating the beam upon movement of the beam in at least one of the up-and-down directions and for biasing the beam to a neutral position.

2. A teeter-totter according to claim 1 wherein the means on the base for coupling the beam to the base comprises a fixed toothed member on the base engageable with the spring means.

3. A teeter-totter according to claim 2 wherein the spring means is substantially U-shaped having a center portion thereof secured to the beam and opposite depending spring arms, and wherein the fixed toothed member comprises a circular member on the base having teeth on the outer periphery thereof.

4. A teeter-totter according to claim 3 wherein the coupling means further comprises a pair of toothed pawls in engagement with substantially diametrically opposed teeth on the circular toothed member, and openings in the pawls for receiving ends of the complementary spring arms.

5. A teeter-totter according to claim 4 wherein the coupling means further comprises a cylindrical member on the support member for rotatably supporting the spring means, and cylindrical end caps mounted on opposite ends of the cylindrical means to retain the spring member on the support member and to form a pivot for the beam.

6. A teeter-totter according to claim 2 wherein the spring means comprises coil spring means having a first end secured to the beam and an opposite end, and wherein the fixed toothed member comprises a circular member on the base having teeth on the outer periphery thereof.

7. A teeter-totter according to claim 6 wherein the coupling means further comprises a pair of toothed pawls in engagement with substantially diametrically opposed teeth on the circular toothed member, and openings in the pawls for receiving opposite end of the coil spring means.

8. A teeter-totter according to claim 7 wherein the coupling means further comprises a cylindrical member on the support member to form a pivot for the beam.

9. A teeter-totter according to claim 1 wherein the spring means comprises a spring arm depending from the beam having one end thereof secured to the beam and the opposite free end thereof engageable with the toothed member.

10. A teeter-totter according to claim 9, and further comprising a pawl having a tooth engageable with the fixed toothed member, and the opposite free end of the spring arm is engagable with the pawl.

11. A teeter-totter according to claim 10 wherein the pawl has a spring for biasing the tooth into engagement with the fixed toothed member, and the pawl further has an opening extending therethrough, and the free end of the spring arm extends through the opening.

12. A teeter-totter according to claim 1 wherein the spring means comprises coil spring means having a first end attached to the beam and an opposite end engageable with the toothed member.

13. A teeter-totter according to claim 12, further comprising a pawl having a tooth engageable with the fixed toothed member, and the opposite end of the coil spring means is engagable with the pawl.

14. A teeter-totter according to claim 13 wherein the pawl has a spring for biasing the tooth into engagement with the fixed toothed member, and the pawl further has an opening extending therethrough, and the opposite end of the coil spring means extends through the opening.

15. A teeter-totter having a beam that simultaneously incrementally rotates as it pivots up-and-down comprising:

a base;

a beam support member rotatably mounted on the base;

a beam mounted for pivotal movement on the beam support member;

a gear support member secured to the base;

a circular gear secured to the gear support member;

at least a pair of toothed pawls spring biased into engagement with the circular gear;

spring means having a first end portion coupled to the beam and a second end portion coupled to said pawl whereby the beam incrementally rotates upon up-and-down movement of the beam.

16. A teeter-totter according to claim 15 wherein the base has an annular land, at least a pair of pawl springs biased into engagement with diametrically opposed teeth of said gear, wherein the gear support member has an apron for holding the pawls for movement on the land, wherein the spring member comprises a pair of spring members arranged in a U-shape having a first end of each spring member coupled to the beam and a second end portion of each spring member coupled to a complementary one of said pawls, wherein the beam support member has a cylindrical ball member for pivotally receiving the beam and the first end portion of the spring members, wherein the mounting means for the first end portion of the spring members comprises a pair of clamp plates for securing the first end portions together and to the beam, and wherein a cylindrical end cap is mounted on each end of the ball member for retaining the beam and spring members onto the beam support member and for providing a support about which the beam pivots.

17. A teeter-totter according to claim 16, and further comprising means for securing at least one of the pawls to the apron to prevent rotatable movement of the beam upon up-and-down movement of the beam.

18. A teeter-totter according to claim 17 wherein the securing means comprises a depending tab on at least one of the pawls, and means for rigidly attaching the tab to the base.

19. A teeter-totter according to claim 15 wherein the base has an annular land, at least a pair of pawl springs biased into engagement with diametrically opposed teeth of said gear, wherein the gear support member has an apron for holding the pawls for movement on the land, wherein the spring member comprises a coil spring means having a first end coupled to the beam and a second end coupled to a complementary one of said pawls, wherein the beam support member has a cylindrical ball member for pivotally receiving the beam, and for providing a support about which the beam pivots.

20. A teeter-totter according to claim 19, further comprising means for securing at least one of the pawls to the apron to prevent rotatable movement of the beam upon up-and-down movement of the beam.

21. A teeter-totter according to claim 20 wherein the securing means comprises a depending tab on at least one of the pawls, and means for rigidly attaching the tab to the base.

* * * * *